United States Patent [19]

Dobson

[11] 4,059,914

[45] Nov. 29, 1977

[54] PANEL DEVICE

[76] Inventor: Charles Edward Dobson, 21 Easton Close, Fishponds, Bristol, England

[21] Appl. No.: 672,601

[22] Filed: Apr. 1, 1976

[30] Foreign Application Priority Data

Apr. 2, 1975 United Kingdom ..... 13736/75

[51] Int. Cl.[2] ..... G09F 7/18

[52] U.S. Cl. ..... 40/125 F; 40/63 R; 40/140; 52/473

[58] Field of Search ..... 40/142 R, 140, 143, 40/63 R, 125 R, 125 K, 125 H, 125 F, 128, 130 R; 52/473, 551, 482, 387, 386

[56] References Cited

U.S. PATENT DOCUMENTS

| | | | |
|---|---|---|---|
| 2,540,790 | 2/1951 | Kost | 52/718 X |
| 2,575,721 | 11/1951 | Lichty | 40/142 R X |
| 2,880,537 | 4/1959 | Cygan | 40/63 R |
| 3,045,961 | 7/1962 | Cygan | 40/142 R X |
| 3,419,979 | 1/1969 | McVicker et al. | 40/64 R |
| 3,470,640 | 10/1969 | Knowles | 40/63 R X |
| 3,555,715 | 1/1971 | Shell | 40/140 |
| 3,803,790 | 4/1974 | Buck et al. | 52/473 |

FOREIGN PATENT DOCUMENTS

| | | | |
|---|---|---|---|
| 323,832 | 1/1930 | United Kingdom | 24/213 |

*Primary Examiner*—John F. Pitrelli
*Attorney, Agent, or Firm*—Cushman, Darby & Cushman

[57] ABSTRACT

A panel device, particularly a sign board is made up of at least one channel-section display member having a plain front face of predetermined width force fitted onto a support member, which is an extrusion-formed item, by interaction between the legs of its channel and projections on the support. The projections on the support are arranged in pairs and the pairs are regularly spaced apart along the support. The spacing between pairs is the same as increments in width as between different display members so that display members of the same or different widths may be fitted to the support member. The plain face of the display member is to bear indicia or the like.

7 Claims, 2 Drawing Figures

PANEL DEVICE

FIELD OF THE INVENTION

This invention relates to panel devices, particularly for forming sign-boards.

BACKGROUND OF THE INVENTION

It is known to attach panels, letters or other sign components to a fascia by means of studs on one part which are a snap fit in resilient clips on the other part. However, such systems are difficult and time-consuming to install accurately, and do not readily lend themselves to the production of neat arrays of signs which may incorporate various different widths of sign plate.

SUMMARY OF THE INVENTION

The present invention provides an improved panel device, particularly a sign-forming system, which is versatile and easy to install.

According to the present invention there is provided a panel device, comprising a plate and at least two mounting members, the plate being elongate and of channel cross-section, the opposed side walls of the channel being shaped to provide a somewhat constricted mouth, each mounting member having an elongate base with a number of similar head portions uniformly spaced apart along its length, each head portion having a pair of elements spaced apart lengthwise of the mounting member, the elements of each pair being mutually outwardly convex and resiliently compressible towards each other, the outside width of the plate corresponding to the unit center-to-center spacing between adjacent head portions of the mounting members or a multiple of that unit spacing, the distance between the inside surfaces of the opposed side walls of the channel being such as to enable the channel to be a push fit onto the mounting members when the latter are arranged transversely to the length of the channel, two mutually outwardly convex head elements of each mounting member being resiliently deflected thereby and remaining under compression against the inside surfaces of the walls of the channel.

DESCRIPTION OF DRAWINGS AND OF PREFERRED EMBODIMENTS

Figure 1:
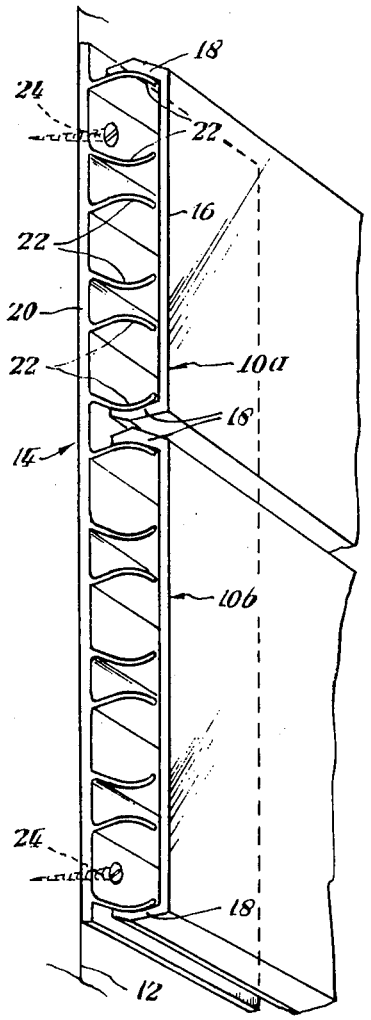
Figure 2:
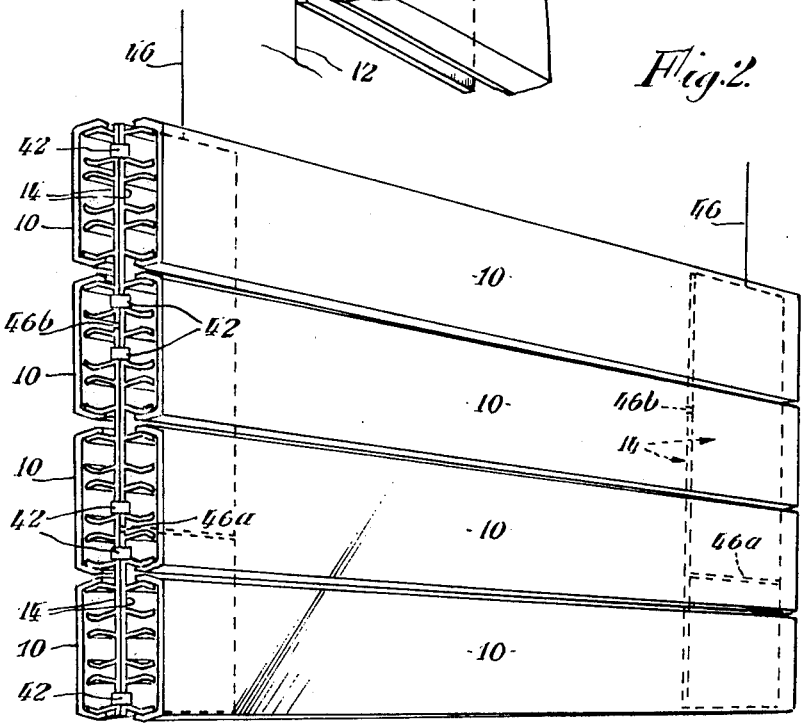

In order that the invention may be more clearly understood, various embodiments of the invention as a sign-board will now be described with reference to the accompanying drawings, wherein:

FIG. 1 shows an end view of one embodiment of sign suitable for fixing to a wall, and FIG. 2 shows a perspective view of a double-sided suspended sign.

Referring to the drawings, and firstly to FIG. 1; the sign comprises a pair of sign plates 10*a*, 10*b* mounted to a wall 12 by means of a mounting member 14. Each sign plate is suitably extruded from aluminium, and is of channel cross-section, having a fascia panel 16 and a pair of rearwardly directed channel walls 18. The two sign plates are of essentially similar form, differing only in the channel width. Mutually facing surfaces of the side walls 18 of each sign plate are concave so that the mouth of the channel is slightly narrower than the widest region of the channel just inwardly of the mouth. The mounting member is also suitably extruded from aluminium, and has a cross-section as shown in FIG. 1. It comprises a base plate 20 having a plane rear surface, and pairs of opposed limbs 22 projecting from its front surface, each pair of limbs being outwardly convex, and forming a number of similar head portions uniformly spaced apart across the mounting member. As can be seen from the drawing, the widths of the sign plates are chosen so as to correspond to the unit center-to-center spacing between the head portions or multiples of that unit spacing. In this particular embodiment, the width of the plate 10*a* is three units, while that of plate 10*b* is four units. However, plates of any suitable width from one unit upwards can be employed. By this means, the channel of the sign plate accommodates the corresponding number of head portions on the mounting member, and the two outer limbs 22 thereof engage inside surfaces of the side walls 18 of the channel. Because the limbs 22 are relatively thin in cross-section, they are resiliently slightly deflectable, so that the sign plate is a push fit onto the mounting member, and can be similarly pulled therefrom. However, the internal cross-section of the sign plate channel is carefully dimensioned so that the engaged limbs 22 remain under compression even when fully engaged within the channel mouth. By this means, a frictional engagement is maintained which resists relative sliding of the mounting member along the channel.

The mounting member is secured to the wall 12 by means of screws 24, which are passed through apertures made in the base plate 20 between a pair of limbs 22. The head of the screw is accessible to a screw-driver inserted between the pair of limbs. A single mounting member could be used having the same length as the sign plates, or preferably somewhat shorter to prevent the mounting member from being readily visible, but for the sake of economy it is preferred to use two (or if necessary more than two) narrow sections of mounting member cut from the extrusion. Thus, each mounting member is elongate in the direction transverse to the length of the sign plate channel. The two mounting members are secured to the wall at a suitable distance apart, by means of the screws 24, and the sign plates, bearing the desired indicia, are pressed in place on the mounting members. Apart from economy, the use of narrow sections of the mounting member extrusion enables the mounting member to be readily severed in between the head portions in the event that the span of the mounting members does not correspond to the total span of the sign plate or plates employed. If necessary, in the case of relatively large sign arrangements, two or more lengths of mounting member can be secured in place end-to-end to achieve the desired span. Also, the use of narrow sections of mounting member enables the outer limbs 22 to be prised apart slightly before fitting the sign plate to provide a stronger grip, if desired.

In a preferred embodiment, the mounting members are narrow sections cut from a standard extrusion of eight unit width. If necessary the sections can then be reduced by cutting off the appropriate number of units. For example, in the form shown in FIG. 1, the mounting member sections have been reduced by one unit to a seven unit width. In the preferred embodiment, the range of sign plate widths includes widths of 2, 3, 4, 6 and 8 units.

The sign arrangement of the present invention has the advantage that no fixing screws are visible; a number of different sign plates can be made up, if necessary with different channel widths; any sign plate can be easily replaced, if necessary; moreover, the sign is very easy to install and has a neat appearance, a uniform spacing between adjacent signs being automatically obtained. The neat appearance is particularly enhanced by the bevelled external surfaces of the channel side walls. The arrangement shown in FIG. 1 is particularly suitable for wall mounting of relatively large sign arrangements, and it will be noticed that the mounting member is arranged to hold the sign plates off the wall, which gives a pleasing high-relief appearance.

A mounting member can be made, similar to the member 14 in FIG. 1, but with pairs of limbs 22 projecting from both sides of the base plate 20. In this case, sign plates 10 can be mounted on both sides of the mounting member, which can be suspended or otherwise secured in an open situation where a sign on both sides is required. However, FIG. 2 shows how such a double-sided sign can be made up using standard mounting members. Pairs of mounting members are secured together back to back by means of spring clips 42 which grip the base plates together. Each pair of mounting members has a hole drilled through the base plates at the top edge portion thereof to receive a hook or similar attachment at the end of a suspension wire 44. Two such pairs of mounting members are suspended, spaced apart, for attachment thereto of the sign plates 10 on each side. FIG. 2 also shows how the sign can be of indefinite height by arranging an appropriate number of mounting members edge-to-edge. By ensuring that the meeting point 46*a* between adjacent mounting members on one side does not coincide with the meeting point 46*b* between adjacent mounting members on the other side, the mounting members will all be held together as one unit by the clips 42. Although, for clarity, the mounting members have been shown in FIG. 2 at the ends of the sign, for improved appearance they may be inwardly spaced from the ends. Push-in plastics plugs may be provided for the ends of the sign plates, in this or any of the other embodiments, to improve the appearance.

Instead of being extruded from aluminium, the sign plate or mounting members or both could be extruded or moulded from plastics. The mounting members might also alternatively comprise an array of spring steel clips mounted to an elongate backing element.

In another use of the invention, a sign plate 10 is used as a facing or cladding panel for an interior wall. The support or mounting members extend horizontally along the wall and the longitudinal direction of the panels is vertical. The front face of each panel may be plain or decorated. The frictional engagement between such support or mounting members and the panel is most effective when the panel as well as the supports are of extruded aluminium since then the side walls of the panel have the requisite resistance to outward bowing under that pressure the resilient elements exert.

I claim:

1. A board comprising in combination at least one essentially rigid extruded panel of uniform cross-section, said cross-section being of shallow channel form to provide a planar front surface and a pair of flanges directed rearwardly from opposite edges of the panel and concave on their mutually facing surfaces; and at least two support members arranged behind said panel, the support members being elongate in the direction transverse to the direction of extrusion of said panel and arranged in parallel spaced apart relationship, each support member being a relatively short length cut from an extension so that it is elongate in the direction transverse to the direction of extrusion, the cross-section of the support member extrusion providing a flat base and a plurality of pairs of lugs projecting from at least one face of the base, the pairs of lugs being equidistantly spaced apart across the cross-section so as to define a unit center-to-center spacing, the outer surfaces of each pair of lugs being mutually outwardly convex so as to be spaced apart at their ends which join with the base and at their ends remote from the base and more widely spaced apart intermediate said ends, the lugs being of a thickness which allows them to be resiliently deflectable towards each other to a small degree; the overall width of said panel in the direction transverse to its direction of extrusion being substantially a multiple of said unit center-to-center spacing, such that the panel can be pushed onto the support members by movement in a rearward direction for a snap fit of the rearmost edge portions of the flanges over the mutually outermost lugs of separate pairs of lugs on each support member and a friction fit of said mutually inwardly facing surfaces of the flanges on the lugs.

2. A sign board according to claim 1, wherein each panel bears indicia on its planar front surface.

3. A board as claimed in claim 1 comprising a plurality of said panel members engaged with respective and different lugs on the support members with the parallel edges of each panel member being parallel to the said edges of each other panel member.

4. A board as claimed in claim 3 wherein the said overall widths of two of the panel members are different corresponding to different multiples of said center-to-center spacing.

5. A board as claimed in claim 1, wherein the elongate support members are provided with said pairs of lugs projecting from opposite sides of their base members, whereby a plurality of panel members can be supported thereby in back to back relationship to form a double-sided board.

6. The improvement as claimed in claim 1 wherein at least one panel member is an extrusion of aluminium.

7. The improvement as claimed in claim 1 wherein each support member is from an extrusion of aluminium.

* * * * *